US010004664B2

(12) United States Patent
Aldasouqi et al.

(10) Patent No.: US 10,004,664 B2
(45) Date of Patent: Jun. 26, 2018

(54) PILL DISPENSER

(71) Applicant: SYMPILL, LLC, East Lansing, MI (US)

(72) Inventors: Bara Aldasouqi, East Lansing, MI (US); Philip Skinkle, Jackson, MI (US); William Burek, Livonia, MI (US); Nickolas Santi, Washington, MI (US)

(73) Assignee: SYMPILL, LLC, East Lansing, MI (US)

( * ) Notice: Subject to any disclaimer, the term of this patent is extended or adjusted under 35 U.S.C. 154(b) by 0 days. days.

(21) Appl. No.: 15/417,900

(22) Filed: Jan. 27, 2017

(65) Prior Publication Data

US 2017/0231871 A1 Aug. 17, 2017

Related U.S. Application Data

(60) Provisional application No. 62/288,235, filed on Jan. 28, 2016.

(51) Int. Cl.
*B65D 83/04* (2006.01)
*A61J 7/00* (2006.01)

(52) U.S. Cl.
CPC ..... *A61J 7/0084* (2013.01); *B65D 83/04* (2013.01)

(58) Field of Classification Search
CPC .... B65D 83/0409; B65D 83/04; A61J 7/0409; A61J 7/0436; A61J 7/0454; A61J 7/0418; A61J 7/0445; A61J 7/0481; A61J 7/02
USPC .... 221/64, 65, 260, 263, 267; 215/206, 208, 215/332, 334
See application file for complete search history.

(56) References Cited

U.S. PATENT DOCUMENTS 3,991,908 A 11/1976 Thomas et al.
4,782,981 A * 11/1988 Schuster ..... B65D 83/0409 206/540
5,791,515 A 8/1998 Khan et al.
6,256,963 B1 * 7/2001 Kim ..... B65B 5/103 221/265
7,204,391 B2 4/2007 Toker
7,992,748 B2 * 8/2011 Lawrence ..... G07F 11/54 221/203
9,501,890 B2 * 11/2016 Rudek ..... G07F 11/54
(Continued)

FOREIGN PATENT DOCUMENTS

WO 9728066 A1 8/1997

*Primary Examiner* — Timothy R Waggoner
*Assistant Examiner* — Ayodeji T Ojofeitimi
(74) *Attorney, Agent, or Firm* — Brooks Kushman P.C.

(57) ABSTRACT

A pill dispenser is provided with a floor, a rotor rotatably coupled adjacent the floor, a base coupled to the rotor, and an indexing mechanism coupled to the rotor to index the rotor in a rotational direction relative to the base to a plurality of index positions. The floor is adapted to be coupled to a shell to define an inner cavity for receiving pills. The floor has a funneled opening extending therethrough. The rotor has a plurality of pill receptacles extending from a top surface to a bottom surface and a plurality of corresponding separation ramps. Each separation ramp extends from the top surface downward to connect with one side of the corresponding pill receptacle. In each of the index positions, one of the pill receptacles aligns with an exit of the funneled opening and another of the pill receptacles aligns with a pill-dispense opening of the base.

20 Claims, 11 Drawing Sheets

(56) References Cited

U.S. PATENT DOCUMENTS

| | | | | |
|---|---|---|---|---|
| 9,636,279 | B2 * | 5/2017 | Song | A61J 7/0427 |
| 2007/0007301 | A1 | 1/2007 | Kaplan et al. | |
| 2009/0283538 | A1 * | 11/2009 | Collins | A61J 7/02 221/1 |
| 2015/0090733 | A1 * | 4/2015 | Park | B65D 83/0409 221/1 |

* cited by examiner

PILL DISPENSER

CROSS-REFERENCE TO RELATED APPLICATIONS

This application claims the benefit of U.S. provisional application Ser. No. 62/288,235 filed Jan. 28, 2016, the disclosure of which is hereby incorporated in its entirety by reference herein.

TECHNICAL FIELD

This application generally relates to pill dispensers. Specifically, this application relates to pill dispensers that accommodate pills of different shapes and sizes and dispenses the pills one dose at a time.

BACKGROUND

Pill dispensers may be used to store and dispense pills when needed. It may be desirable to ensure the pills dispense one dose at a time without getting jammed. Furthermore, it may be desirable to have a pill dispenser with interchangeable parts to accommodate pills of different shapes and sizes. In addition, it may be desirable to include dosage indicia on the pill dispenser to inform the user of his/her current dosage (and/or last dosage taken).

SUMMARY

According to at least one embodiment, a pill dispenser includes a floor adapted to be coupled to a shell to define an inner cavity disposed above the floor for receiving a plurality of pills. The floor has a funneled opening extending therethrough. The funneled opening has an entrance at a top of the floor and a smaller exit below the entrance at a bottom of the floor. The dispenser further includes a rotor rotatably coupled adjacent the bottom of the floor and having a plurality of pill receptacles extending from a top surface to a bottom surface of the rotor and a plurality of corresponding separation ramps. Each separation ramp extends from the top surface downward to connect with one side of the corresponding pill receptacle. The dispenser further includes a base coupled to the rotor opposite the floor and having a pill-dispense opening. The dispenser further includes an indexing mechanism coupled to the rotor to index the rotor in a rotational direction relative to the base to a plurality of index positions. In each of the index positions one of the pill receptacles aligns with the exit of the funneled opening and another of the pill receptacles aligns with the pill-dispense opening.

According to another embodiment, a pill dispenser includes a floor adapted to be coupled to a shell to define an inner cavity for storing a plurality of pills. The floor has a funneled opening extending therethrough. The dispenser further includes a rotor rotatably coupled to the floor and having a plurality of pill receptacles extending from a top surface to a bottom surface of the rotor and a plurality of corresponding separation ramps. Each separation ramp extends from the top surface downward to an intermediate height of the corresponding pill receptacle. Each pill receptacle has a width for containing a small dimension of the pills and a total height greater than the intermediate height. The intermediate height is less than a large dimension of the pills. The dispenser further includes a base coupled to the rotor opposite the floor and having a pill-dispense opening. The dispenser further includes an indexing mechanism coupled to the rotor to index the rotor in a rotational direction relative to the base to a plurality of index positions. In each of the index positions one of the receptacles of the plurality aligns with the pill-dispense opening.

According to another embodiment, a pill dispenser includes a shell having an inner cavity to receive a plurality of pills. The shell has a plurality of funneled openings defined along a floor of the shell. Each funneled opening is sized to receive at least one of the plurality of pills. The dispenser further includes a rotor coupled to the shell adjacent the floor and having a plurality of pill receptacles extending through the rotor. The dispenser further includes a base coupled to the rotor opposite the shell and having a pill-dispense opening. The dispenser further includes an indexing mechanism coupled to the rotor to index the rotor relative to the base to a plurality of index positions. In each index position one of the funneled openings aligns with one of the pill receptacles and one of the pill receptacles aligns with the pill-dispense opening.

BRIEF DESCRIPTION OF THE DRAWINGS

FIGS. 7A-7B are see-through partial perspective views of another floor that may be used with the dispenser of FIG. 1 in accordance with another embodiment of the instant disclosure.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
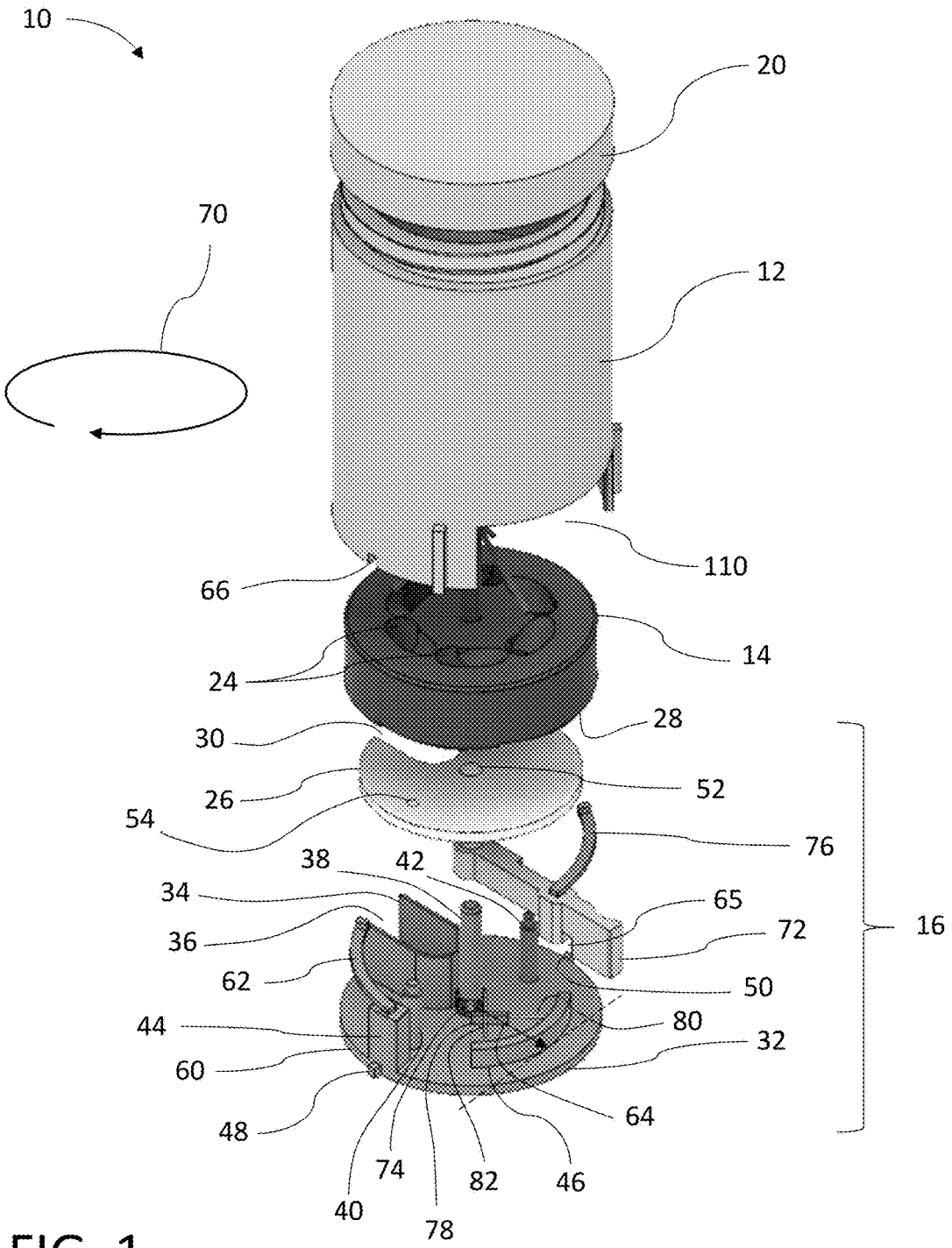
FIG. 1 is an exploded view of a pill dispenser in accordance with an embodiment of the present disclosure.

FIG. 1 is an exploded view of a pill dispenser 10 in accordance with an embodiment of the present disclosure. In the illustrated embodiment, the pill dispenser 10 includes a shell 12, a rotor 14, a base 16, and an indexing mechanism 18. The shell 12 is a generally cylindrical tube and forms an outer surface of the dispenser 10. An upper portion of the shell 12 forms the inner cavity 22 configured to hold the pills that need to be dispensed. The shell 12 may include a removable cap 20 to open and close the dispenser 10 and to provide access to the inner cavity 22 (FIG. 2) of the shell 12. A lower portion of the shell 12 houses the rotor 14, base 16, and indexing mechanism 18. The shell 12, like the rotor 14 and base 16, may be injection molded of plastic or formed of any suitable material. In the illustrated embodiment, the shell 12 remains fixed relative to the rotor 14.

In the illustrated embodiment, the rotor 14 is rotatably coupled to the shell 12 and base 16 and also has a plurality of pill receptacles 24. The rotor is disposed above the base 16 and indexing mechanism 18. As will be described in more detail below, the rotor 14 is rotatable to a plurality of index dispense positions through actuation of the indexing mechanism 18. The rotor 14 has a generally circular circumference. The receptacles 14 are disposed inboard of the circumference and extend through a thickness of the rotor 14. The rotor 14 may be injection molded of plastic or formed of any suitable materials.

In the illustrated embodiment, the base 16 is also housed in the shell 12 below the rotor 14. The base includes a plate 26 that is fixed and does not rotate and abuts a bottom surface 28 of the rotor 14. The plate 26 is circular and has a slot 30 cut out in the plate 26 that extends a distance from the periphery of the plate 26 radially inward toward the center of the plate 26. The plate 26 prevents the pills residing in all the receptacles 24 of the rotor 14 from falling out of the rotor 14 except for the receptacle 24 disposed above the slot 30. When a receptacle 24 is positioned above and aligned with the slot 30, the pill residing in that receptacle 24 falls out of the receptacle 24 and out the dispenser 10 (with the assistance of gravity). The radially innermost portion of the pill-dispense opening 36 aligns with the radially innermost portion of the receptacles 24 to allow the pill residing in the receptacle 24 to fall through the slot 30. A diameter of the plate 26 is less than a diameter of the rotor 14 to allow the indexing mechanism 18 to engage with an outer periphery of the bottom surface 28 of the rotor 14 (described in more detail below). The plate 26 may be injection molded of plastic or formed of any suitable materials.

In the illustrated embodiment, the base 16 includes a support 32 defining a bottom of the dispenser 10. The support 32 is positioned below the plate 26 and remains fixed. The support 32 may be a circular upper surface from which other elements are attached and extend upwards to engage with the plate 26 and rotor 14. The support 32 may be injection molded of plastic or formed of any suitable materials.

In the illustrated embodiment, the support 32 has a curved wall 34 that extends from an outer edge 60 of the support 32 radially inward toward the center. The curved wall 34 defines a pill-dispense opening 36 that is aligned with the slot 30. As the pill falls out of the receptacle 24 aligned with the slot 30 of the plate 26, the pill also falls through the pill-dispense opening 36 out of the dispenser 10. In one embodiment, the top of the curved wall 34 abuts the plate 26 and has the same shape and curvature as the slot 30 of the plate 26. Although the pill-dispense opening 36 is configured such that the pills fall out a side of the dispenser 10, the pill-dispense opening 36 may have a cut-out in the support 32 such that the pills fall out of a bottom of the dispenser 10 as well.

In the illustrated embodiment, a support shaft 38 and support posts 40, 42 are integrally molded with the support 32. In another embodiment, the shaft 38 and posts 40, 42 may be attached to the support 32, such as with adhesive or fasteners, for example. The support shaft 38 extends upwards from a center of the support 32 through an aperture 52 of the plate 26 and into rotor 14 such that the support shaft 38 rotatably supports the rotor 14. The support shaft 38 is generally cylindrical.

In the illustrated embodiment, the support posts 40, 42 are positioned radially outwardly from the support shaft at a uniform distance and are diametrically opposed of one another such that the support posts 40, 42 do not interfere with the indexing mechanism 18. The support posts 40, 42 extend upwards through apertures 54, 56 of the plate 26 to support the plate 26 at a height 58 (FIG. 2) from a bottom surface of the support 32. Each of the support shafts 40, 42 have a larger cylindrical portion below a smaller cylindrical portion to form a radially outwardly extending lip upon which the plate 26 rests. One of ordinary skill in the art will understand that there are several ways to suspend and support the plate 26 and the appropriate height relative to the rotor 14. For example and without limitation, the support shaft 38 may be configured to have a radially outwardly extending surface upon which the plate 26 may rest.

In the illustrated embodiment, a stopping leaf spring post 44 also extends upward from the support 32. The stopping leaf spring post 44 supports and positions a stopping leaf spring of the indexing mechanism 18 at an appropriate height such that the stopping leaf spring can engage with the bottom surface 28 of the rotor 14. The stopping leaf spring post 44 extends upwards from the support 32 and is disposed at the outer edge 60 of the support 32 adjacent to one of the support posts 40 so as to not interfere with the indexing mechanism 18. The stopping leaf spring post 44 may be positioned elsewhere on the support 32. For example and without limitation, the stopping leaf spring post 44 may be disposed on the other side of the support proximate the pill-dispense opening.

In the illustrated embodiment, a guide 46 also extends upward from the support 32. The guide 46 is shaped to cooperate and engage a guide slot 65 of the indexing mechanism 18. The guide 46 extends upwards from a top surface of the support 32 and is arcuate. The guide 46 is disposed at a radial distance 64 from the support shaft 38 to align with the guide slot 65. As the indexing mechanism 18 is actuated, the guide slot 65 moves along the guide 46. The guide 46 may be omitted in some embodiments.

As further illustrated in the embodiment of FIG. 1, the alignment tabs 48, 50 aid in positioning the shell 12 over the rotor 14 and base 16 in the proper angular orientation. The alignment tabs 48, 50 are diametrically opposed from one another and extend radially outwardly from the outer edge 60 of the support 32. When assembled, the alignment tabs 48, 50 are disposed within slots 66, 68 of the shell 12. The alignment tabs 48, 50 are shown as being generally square-shaped; however, the alignment tabs can be any shape or size. In some embodiments, the shell 12 may be selectively fastened to the base 16 using a snap-fit joint, such as an annular snap joint.

Figure 2:
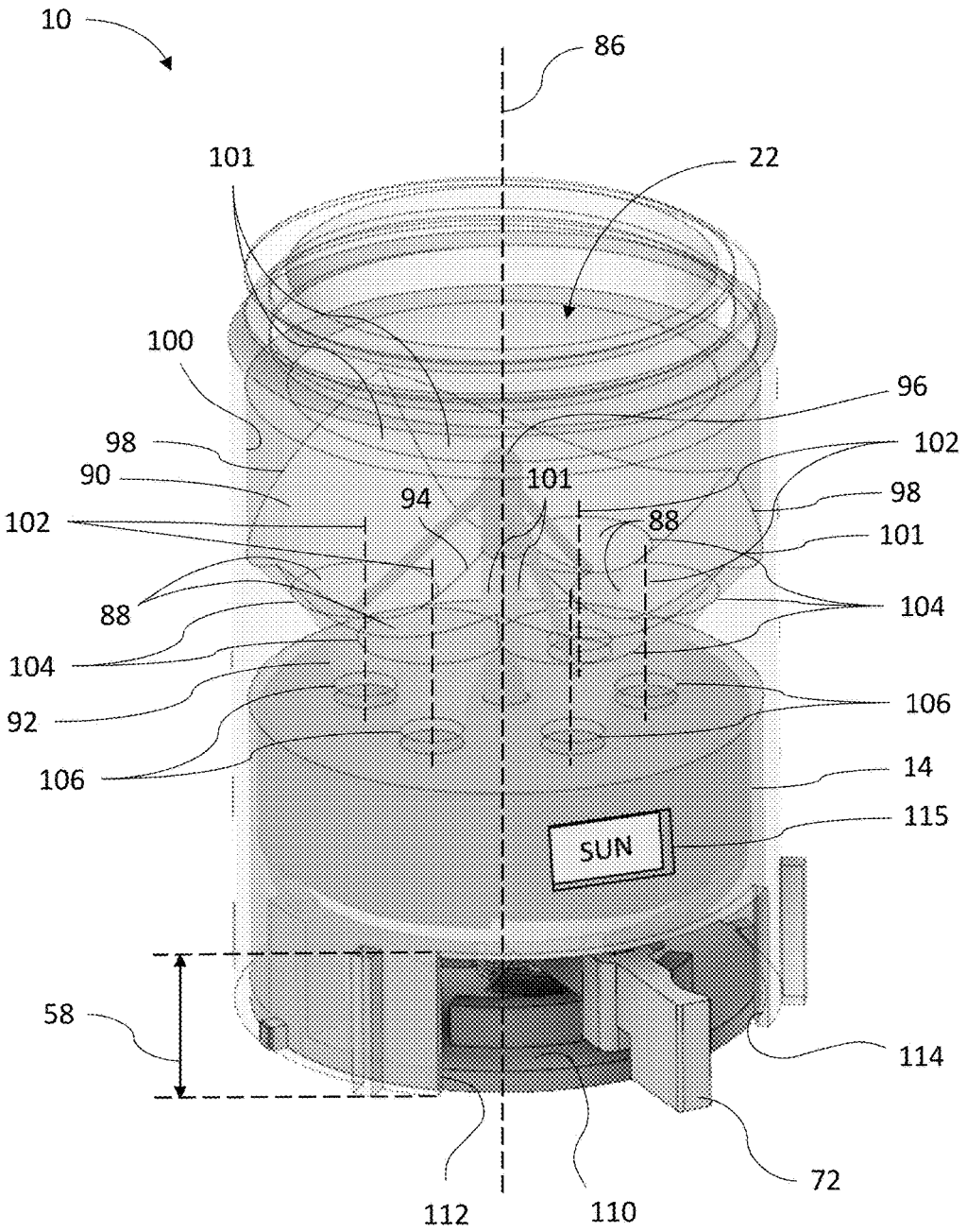
FIG. 2 is a perspective view of the pill dispenser of FIG. 1 as assembled and also showing the interior of a shell of the pill dispenser of FIG. 1.

In the illustrated embodiment, the indexing mechanism 18 allows indexing of the rotor 14 in a rotational direction 70 to a plurality of index positions. The indexing mechanism 18 is disposed between the support 32 and the rotor 14. One actuation of the indexing mechanism 18 rotates the rotor 14 by a rotational angle such that the next receptacle 24 of the rotor 14 becomes aligned with the pill-dispense opening 36. For a rotor 14 with six receptacles 24, the indexing mechanism 18 rotates the rotor 14 by the rotational angle being approximately sixty to sixty-five degrees about a central longitudinal axis 86. The central longitudinal axis 86 extends through the center of the dispenser 10 from top to bottom and serves as the axis of rotation, as shown in FIG. 2. The indexing mechanism 18 also includes an actuation lever 72, a biasing member 74, an indexing leaf spring 76 coupled to lever 72, and stopping leaf spring 62 to effect movement of the rotor 14 to each of the indexing positions.

In the illustrated embodiment, a user actuates the actuation lever 72 to rotate the rotor 14 to an index position and to dispense a pill. The actuation lever 72 is rotatably coupled to the support shaft 38 at one end by an aperture through which the support shaft 38 extends. The actuation lever 72 extends from the support shaft 38 radially outwardly past the outer edge 60 of the support 32 through an aperture 110 of the shell 12 to give access to the user of an actuation end of the lever 72, as shown in FIG. 2. The actuation lever 72 may be injection molded of plastic or formed of any suitable materials. One of ordinary skill in the art will understand that there are number of ways to index the rotor to the index positions with or without the use of a lever that extends outwardly from the shell.

In the illustrated embodiment, the biasing member 74 biases the lever 72 opposite the rotational direction 70 to a home position. The biasing member 74 may be a helical spring so that the support shaft 38 extends through the inner diameter of the helical spring. The support 32 may further include a stop 78 extending upwards from support 32 to prevent further rotational movement of an end 80 of biasing member 74 in rotational direction 70. The stop 78 may be positioned proximate the biasing member 74. The stop 74 may be positioned such that its length runs parallel to the end 80 of the biasing member 74. The biasing member 74 also includes an end 82 opposite the end 80 for engagement with the lever 72 (discussed in more detail below). The end 82 abuts one side of the lever 72 to bias the lever 72 to the home position. In one embodiment, the lever includes an extrusion that extends downward toward the support 32, with one side of the extrusion abutting the end 82 of the biasing member 74. The biasing member 74 may be metal or plastic with an inner diameter slightly larger than an outer diameter of the support shaft 38.

In the illustrated embodiment, the leaf springs 62, 76 are biased upwards to engage with the bottom surface 28 of the rotor 14. As will be described in more detail below with reference to FIGS. 8A-8B, the indexing leaf spring 76 allows the lever 72 to move the rotor 14 to the index positions, and the stopping leaf spring 62 prevent movement of the rotor 14 opposite the rotational direction 70 as the lever 72 returns to the home position.

FIG. 2 is a perspective view of dispenser 10 of FIG. 1 illustrating the dispenser 10 as assembled and also showing the interior of the shell 12. In the illustrated embodiment, the shell 12 further includes a floor 84 having a plurality of funneled openings 88. The top 90 of the floor 84 defines the lower boundary of the inner cavity 22 and has a plurality of tapered portions 101 that are shaped to direct the pills toward the funneled openings 88. The tapered portions 101 each have a raised center section 94 that extends radially outwardly and downward from the axis 86 to the respective funneled opening 88. Each tapered portion 101 also has a raised outer section 98 that extends radially inwardly and downward from an inner wall 100 of the shell 12 at an outer perimeter of the floor 84 to the respective funneled opening 88. The tapered portions 101 may be generally bowl-shaped with the respective funneled opening 88 disposed at the bottom of the bowl. The raised outer sections 98 and the raised center sections 94 of the tapered portions 101 are disposed at a greater height than entrances 104 of the funneled openings 88 to direct the pills toward the adjacent funneled openings 88. In one embodiment, the floor 84 may be injection molded with the shell 12 as one piece (as plastic or other suitable materials). In another embodiment, the floor is a separate piece from the shell 12 and can be selectively coupled to the shell 12. Although in the illustrated embodiment shell 12 and floor 84 are fixed relative to rotor 14, shell 12 and/or floor 84 may rotate relative to rotor 14 (or relative to another component).

As illustrated in FIG. 2, each tapered portion 101 connects to a funneled opening 88. Each funneled opening 88 is shaped to stack the pills in a desired orientation (as will be described below). Exits 106 of the funneled openings 88 are sized such that the pills can only exit the funneled openings 88 in one orientation. The funneled openings 88 extend through the floor 94 from the top 90 to the bottom 92. The funneled openings 88 are circumferentially spaced at a uniform radial distance relative to the axis 86. Each of the funneled openings 88 includes the entrance 104 at the top 90 of the floor 84 and the exit 106 below the entrance 104 at the bottom 92 of the floor 84. The funneled openings 88 gradually reduce in size between their entrances 104 and exits 106 such that the exits 106 are smaller in diameter than the entrances 104. In one embodiment, the entrance 104 and exit 106 may be centered around a funnel axis 102, which extends through the center of the funneled opening 88 from the entrance 104 to the exit 106. In the illustrated embodiment, the shell 12 has five funneled openings 88, each being angularly offset from the pill-dispense opening 36 relative to the axis 86. However, the floor may have more or less funneled openings. Furthermore, although funneled openings 88 are illustrated as being generally identical in size and shape, the funneled openings may be dissimilar in size and/or shape in other embodiments. In each of the index positions, each of the funneled openings 88 is angularly aligned with one of the receptacles 24 of the rotor 14 such that a receptacle 24 receives a pill from the respective funneled opening 88.

Still referring to FIG. 2, in the illustrated embodiment, a bottom of the shell 12 defines an aperture 110 through which the actuation lever 72 extends. The aperture 100 is diametrically opposite of the pill-dispense opening 36 (FIG. 1). The walls 112, 114 of the aperture 110 serve as stops for the lever 72. To move the rotor 14 to the index positions, the lever 72 pivots between a home position and a dispense position. As the lever 72 moves from the home position to the dispense position, the rotor 14 correspondingly moves from one index position to the next (adjacent) index position. In the home position, the lever 72 is biased (by biasing member 74) to contact end 114, and in the dispense position, the user pivots the lever 72 to contact end 112.

Still referring to FIG. 2, the rotor 14 may be disposed within the shell 12, and the shell 12 may include an indicator window 115 over an outer wall of the rotor 14 such that in each of the index positions, dosage indicia included on the outer wall of the rotor 14 is viewable through the indicator window 115. In the illustrated embodiment, the indicator window 115 is disposed above the aperture 110. In other embodiments, the indicator window 115 may be a digital display that indicates the amount of time that elapsed since the last dose was dispensed.

Although the shell 12 is illustrated as being a part of the dispenser 10, the shell may be the shell of a pill bottle separate from the dispenser 10. The dispenser 10, with the floor 84 and funneled opening(s) 88, may be selectively attachable to the shell of the pill bottle. In such embodiments, the floor 84 with the funneled opening(s) 88 may be disposed within the inner cavity of the pill bottle shell or disposed outside the bottle and adjacent to an opening of the pill bottle. To dispense the pills, the pill bottle may be inverted upside down such that the pills residing in the inner cavity of the pill bottle fall down through the funneled opening(s) 88 and into the rotor 14 as described herein.

Figure 4:
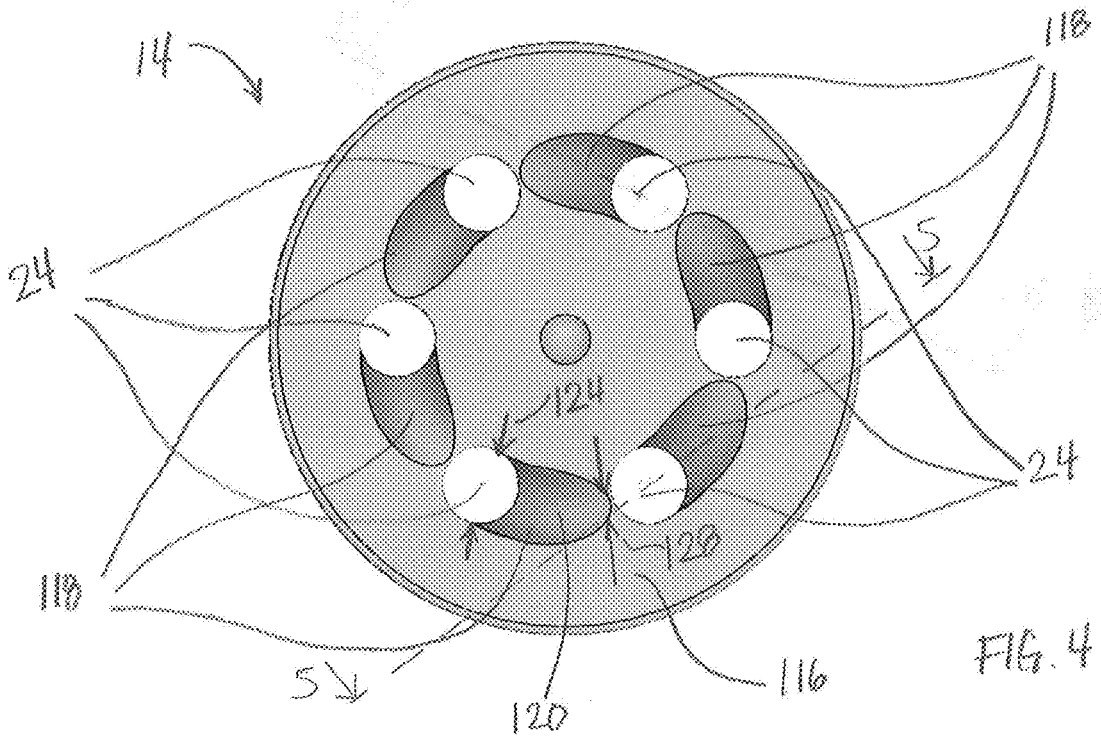
FIG. 4 is a top plan view of the rotor of the pill dispenser of FIG. 1.
Figure 3:
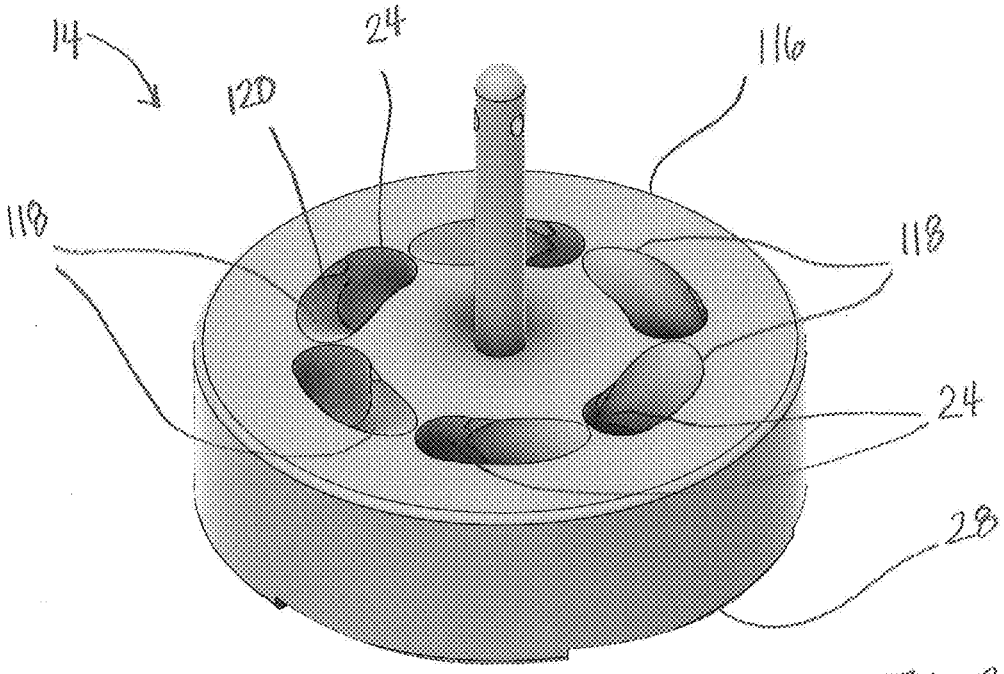
FIG. 3 is a perspective view of a rotor of the pill dispenser of FIG. 1.

FIG. 3 is a perspective view of the rotor 14 of the dispenser 10 of FIG. 1. FIG. 4 is a top plan view of the rotor 14 of the dispenser 10 of FIG. 1. In the illustrated embodiment, each pill receptacle 24 of the rotor 14 is generally cylindrical and extends from a top surface 116 of the rotor 14 to the bottom surface 28 of the rotor 14. The pill receptacles 24 are circumferentially spaced around axis 86 and are disposed at a uniform radial distance from the axis 86.

In the illustrated embodiment, the rotor 14 also includes a plurality of separation ramps 118 configured to ensure only one pill/dose resides in the receptacle 24 at a time (described in more detail below). Each separation ramp 118 extends from the top surface 116 downward in the rotational direction 70 to connect with one side of the respective receptacle 24. In one embodiment, each separation ramp 118 has a bottom surface 120 that has a concave cross-section. Each separation ramp 118 may have a variable width that gradually reduces from a starting width 124 at an intermediate height 126 (FIG. 5) of receptacle 24 to an ending width 128 at top surface 116 of rotor 14 adjacent a preceding receptacle 24. In other embodiments, the separation ramps 118 are relatively flat and have ending widths 128 that are generally equal to the starting widths 124. Although the pill receptacles 24 and corresponding separation ramps 118 are illustrated as being uniform in size and shape, the pill receptacles and/or separation ramps may be dissimilar in size and/or shape.

Figure 5:
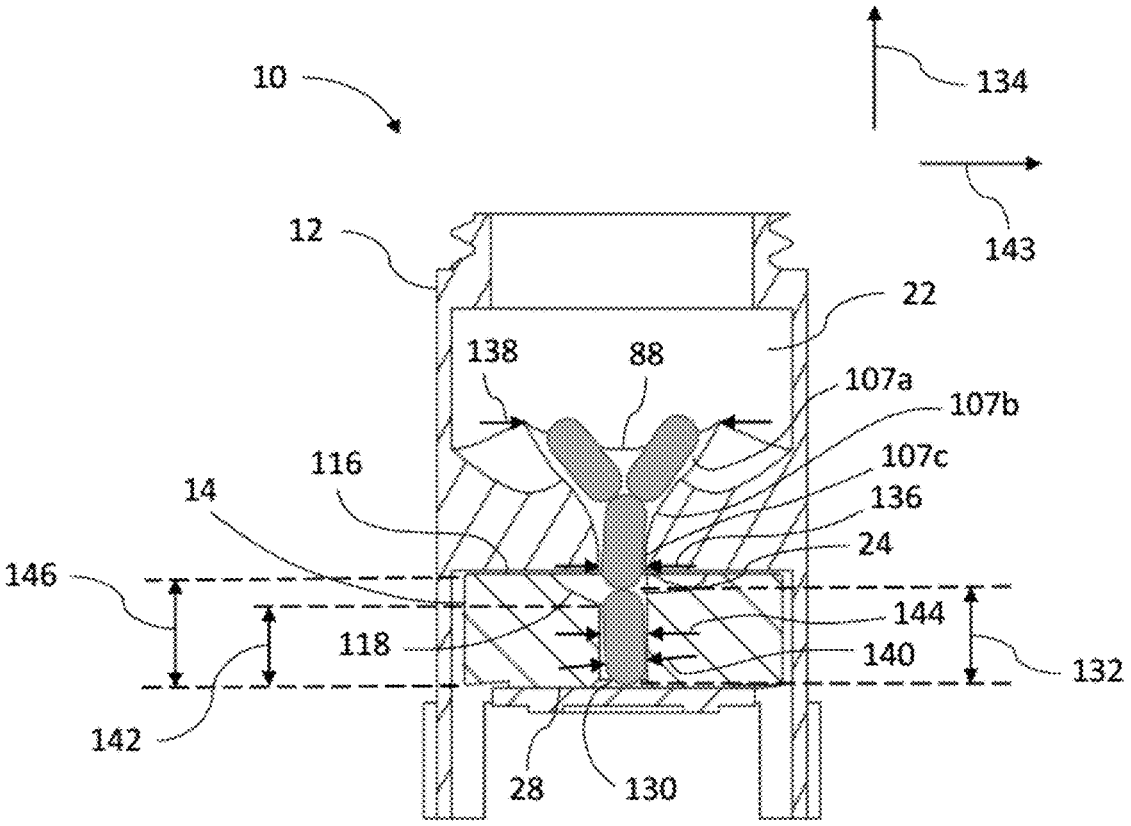
FIG. 5 is a cross-sectional view of the pill dispenser taken along line 5-5 of FIG. 4.

FIG. 5 is a cross-sectional view of the dispenser 10 taken along line 5-5 of FIG. 4 illustrating pills 130 as they are funneled downward through the funneled opening 88 and into the pill receptacle 24 (with the support 32 omitted for clarity). As illustrated, the funneled openings 88 are shaped such that the pills 130 become oriented with their large dimension 132 being oriented in a vertical direction 134 as the pills 130 pass through the exit 106 and prior to entering the receptacle 24 in the rotor 14. In one embodiment, an exit diameter 136 of the funneled opening 88 is sized to allow only one pill 130 to exit the funneled opening 88 through the exit 106 at a time. An entrance diameter 138 of the entrance 104 may be 1.5 to 2 times the large dimension 132 of the pill 130, and the exit diameter 136 of the exit 106 may be 1.05 to 1.20 times a small dimension 140 of the pill 130, where the large dimension 132 is greater than the small dimension 140.

As further shown in FIG. 5, in the illustrated embodiment, the shape of the funneled opening 88 is designed as three regions: a tapered region 107*a*, a transitional region 107*b*, and a cylindrical region 107*c*. The tapered region 107*a* is adjacent to the entrance 104 and is generally frustoconical in shape. The tapered region 107*a* extends downward at an angle from the entrance 104. The cylindrical region 107*c* is disposed adjacent to the exit 106 and is generally cylindrical in shape having a constant diameter. The cylindrical region 107*c* is oriented vertically. The transitional region 107*b* is a rounded region and is disposed between the tapered and cylindrical regions 107*a*, 107*c*. The transitional region 107*b* is rounded to form a fillet with no sharp corners.

Still referring to FIG. 5, the separation ramps 118 extend from the top surface 116 of the rotor 14 downward to an intermediate height 142 of the corresponding pill receptacle 24. The intermediate height 142 is measured from the bottom surface 28 of the rotor 14 to the point where the ramp 118 intersects the pill receptacle opening 144. The intermediate height 142 is less than the large dimension 132 of the pills 130 such that upon indexing the rotor 14, the rotor 14 moves in direction 143 (corresponding to the rotational direction 70) and the separation ramp 118 contacts the preceding pill 130 and pushes it back up into the funneled opening 88 to be dispensed when the rotor 14 is indexed to the next index position. This ensures that the pills 130 are dispensed one dose at a time from the dispenser 10. Furthermore, making the intermediate height 142 less than or equal to the large dimension 132 of the pill 130 ensures that the preceding pill 130 will contact the bottom surface 120 of the separation ramp 118 upon indexing of the rotor 14.

Still referring to FIG. 5, the pill receptacle opening 144 has a main width sized to contain the small dimension 140 of the pill 130. The pill receptacle 24 has a total height 146 greater than the intermediate height 142. Furthermore, in one embodiment, the total height 146 may be 1.2 to 1.3 times the large dimension 132 of the pill 130. In other embodiments where more than one pill may be desired at one time (e.g., two pills at a time for a dose of two pills), the total height of the pill receptacle may be 2.2 to 2.3 times the large dimension 132 of the pill. In the illustrated embodiment, the intermediate height 142 is 75% of the total height 146 such that pills having a large dimension 132 between 75% to 100% of the total height 146 can be properly handled within the dispenser 10. In other embodiments, the intermediate height 142 is in the range of 65% to 85% of the total height 146. Although the illustrated embodiment shows pills 130 having a certain size and shape, the shell 12 and rotor 14 shown may also accommodate pills having slightly different sizes and/or shapes. In some embodiments, the size and shape of the receptacles 24 and funneled openings 88 may be selected to accommodate more than one size and shape of pills.

Figure 6:
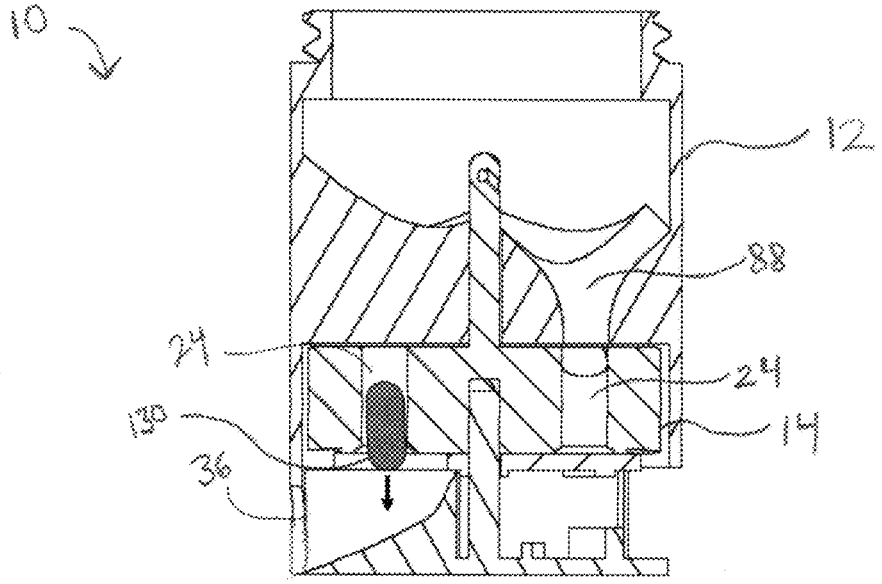
FIG. 6 is a cross-sectional view of the pill dispenser of FIG. 1.

FIG. 6 is a cross-sectional view of the dispenser 10 of FIG. 1 illustrating dispensing of the pill 130 from the pill receptacle 24 of the rotor 14 into the pill-dispense opening 36. As illustrated, upon indexing the rotor 14 to one of the index positions, one of the pill receptacles 24 becomes angularly aligned with the pill-dispense opening 36 to allow the pill 130 residing in the aligned pill receptacle 24 to fall into the pill-dispense opening 36 and out the dispenser 10 with the assistance of gravity. In the illustrated embodiment, the pill-dispense opening 36 is angularly offset from the funneled openings 88 of the shell 12 such that the pills 130 residing in the funneled openings 88 do not fall through the pill-dispense opening 36 when the rotor 14 is in the index positions, thus, ensuring only the pill residing in the pill receptacle 24 of the rotor 14 falls through the pill-dispense opening 36. As best shown in FIGS. 2 and 3, the number of the funneled openings 88 is less than the number of the pill receptacles 24 in the rotor 14. Furthermore, in the illustrated embodiment, the shell 12 has five funneled openings 88, and the rotor 14 has six pill receptacles 24 (and six corresponding separation ramps 118). However, more or less openings and receptacles may be utilized in other embodiments.

Figure 7A:
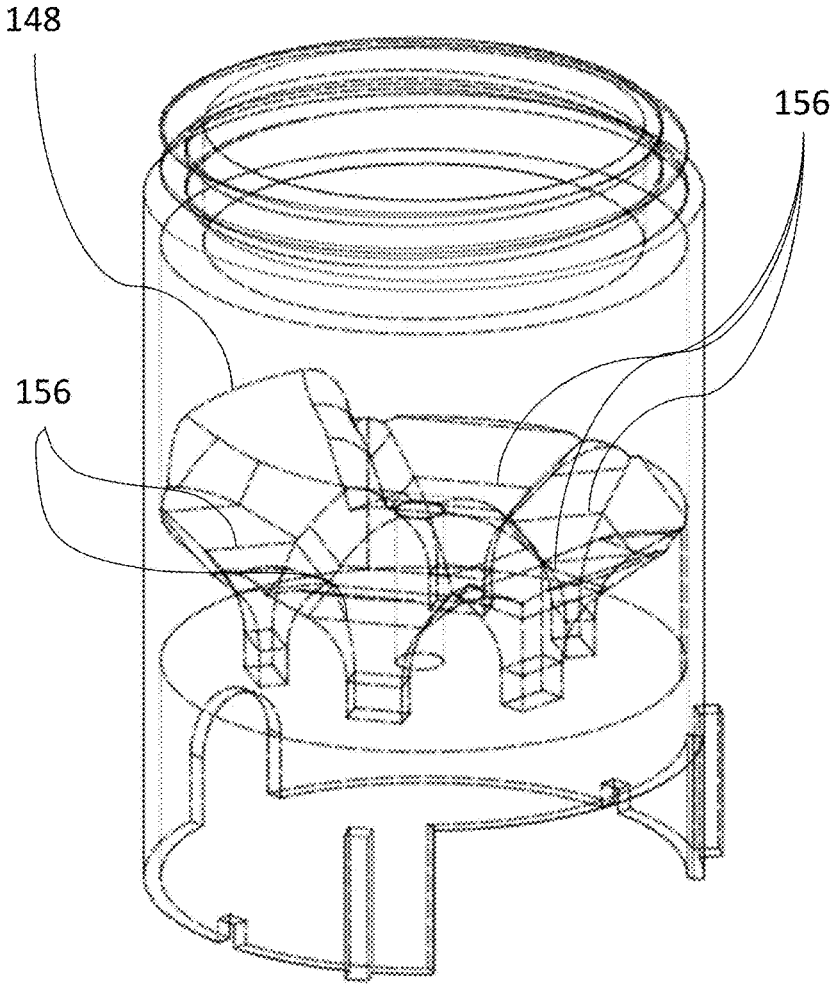
Figure 9B:
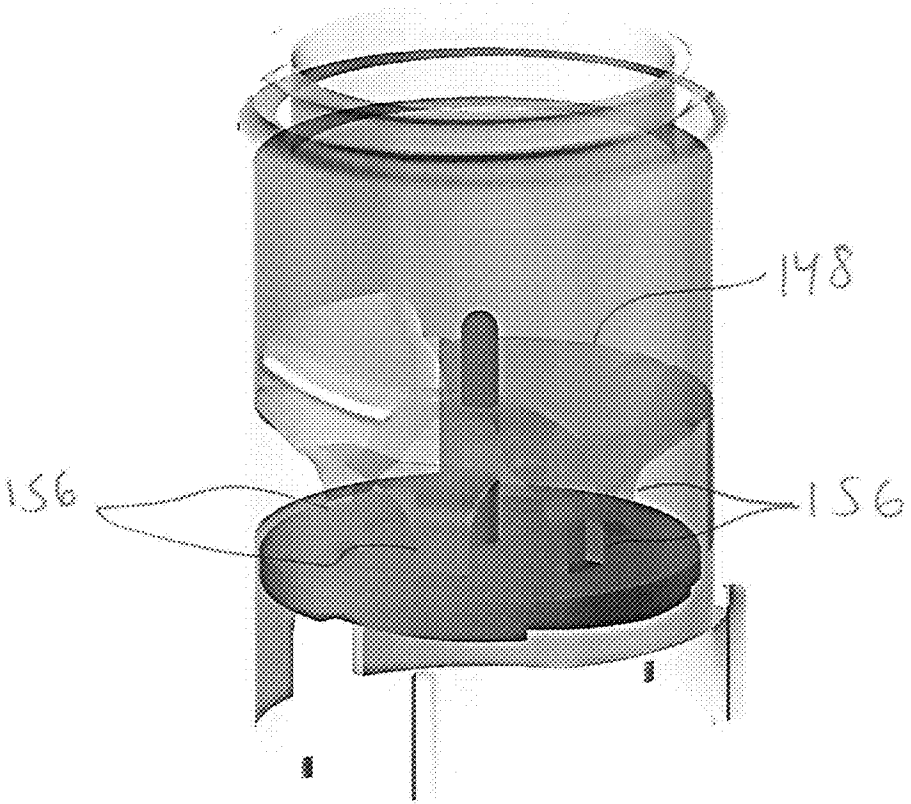
FIG. 9 is a bottom perspective view of the rotor of FIG. 3.
Figure 7C:
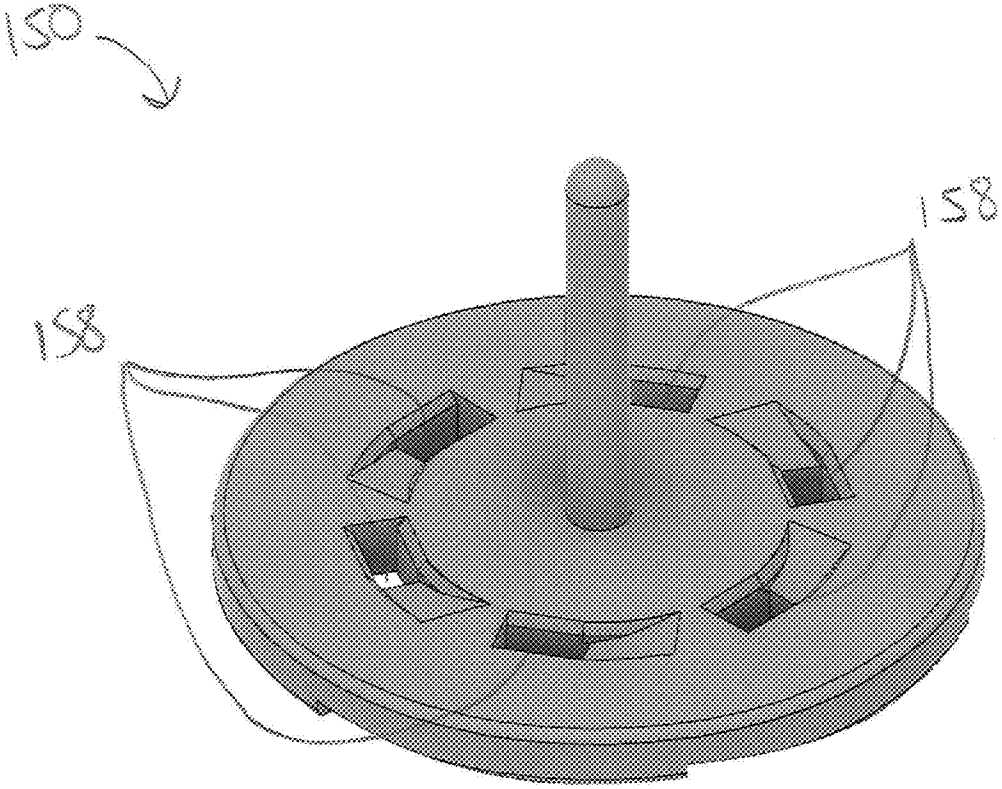
FIG. 7C is a perspective view of another rotor that may be used with the dispenser of FIG. 1 in accordance with another embodiment of the instant disclosure.
Figure 7D:
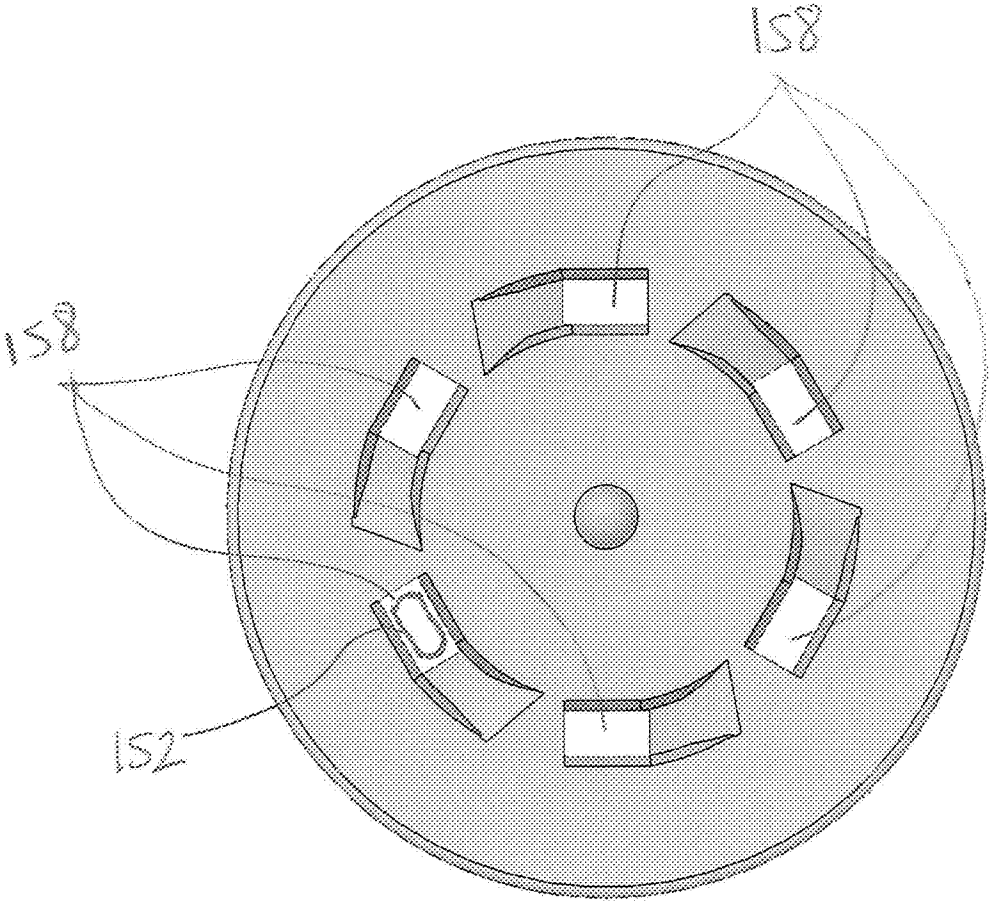
FIG. 7D is a top plan view of the rotor of FIG. 7C.

FIGS. 7A-7B are see-through partial perspective views of another floor 148 that may be used with the dispenser 10 of FIG. 1 in accordance with another embodiment of the instant disclosure. FIG. 7C is a perspective view of another rotor 150 that may be used with the dispenser 10 of FIG. 1 in accordance with another embodiment of the instant disclosure. FIG. 7D is a top plan view of the rotor 150 of FIG. 7C.

The floor 148 and rotor 150 are shaped to accommodate tablet-shaped pills 152 that are generally disc-shaped (and not generally cylindrical like pills 130). When oriented with its large dimension positioned in the vertical direction 134, the tablet-shaped pills 152 have an oval or elongated horizontal cross-section (i.e., non-circular). As such, the funneled openings 156 and pill receptacles 158 may have a rectangular cross section to accommodate the tablet-shaped pills 152. Furthermore, the large dimension of the table-shaped pill 152 is generally less than the large dimension 132 of the pill 130 (capsule shape, described above). As such, the height of the rotor 150 may be less than the height of the rotor 14. To accommodate this decrease in height, the funneled openings 88 can be disposed further down within the shell 12 and/or the distance between the entrance and exit of the funneled opening 156 may be greater. The rotors 14, 150 are supported at the same height within the shell 12. Other than the shape and size of the funneled openings 156 and receptacles 158, the floor 148 and rotor 150 are similar to the floor 84 and rotor 14 described above. As such, one advantage of the instant disclosure is that the floor (or whole shell) and rotor are interchangeable to accommodate different sizes of pills.

Figure 8A:
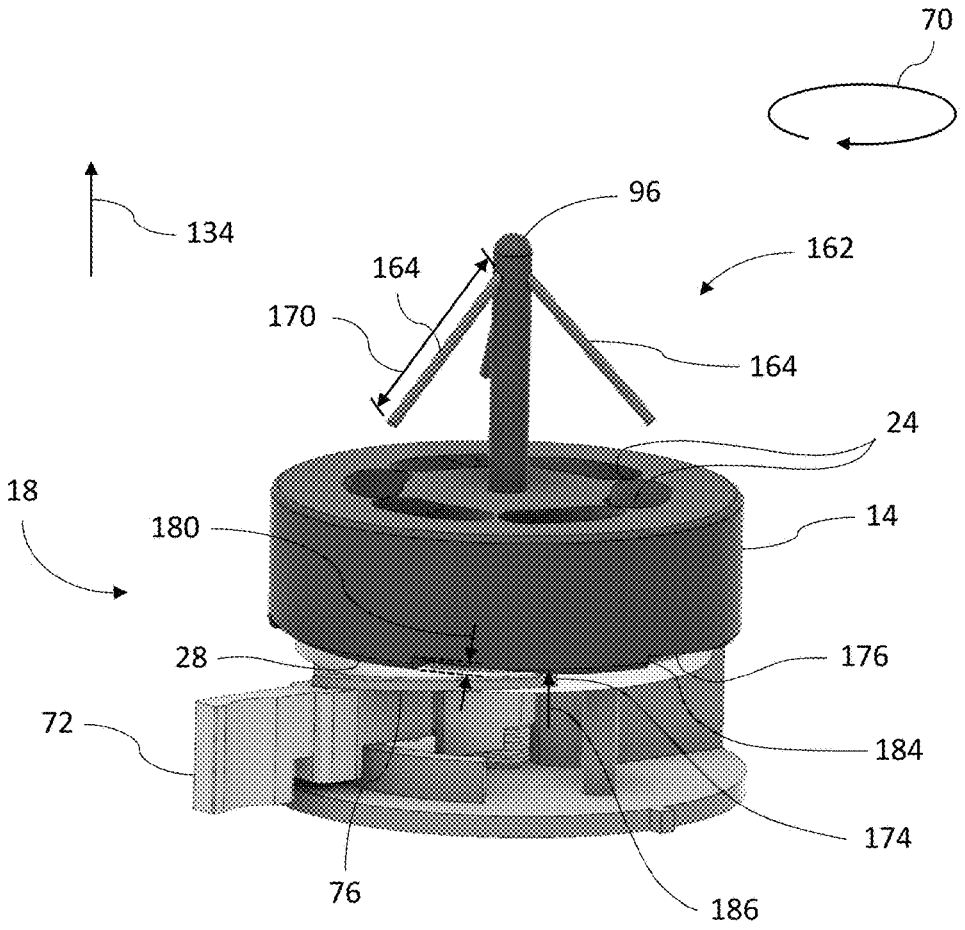
FIGS. 8A-8B are partial perspective views of the pill dispenser of FIG. 1.
Figure 8B:
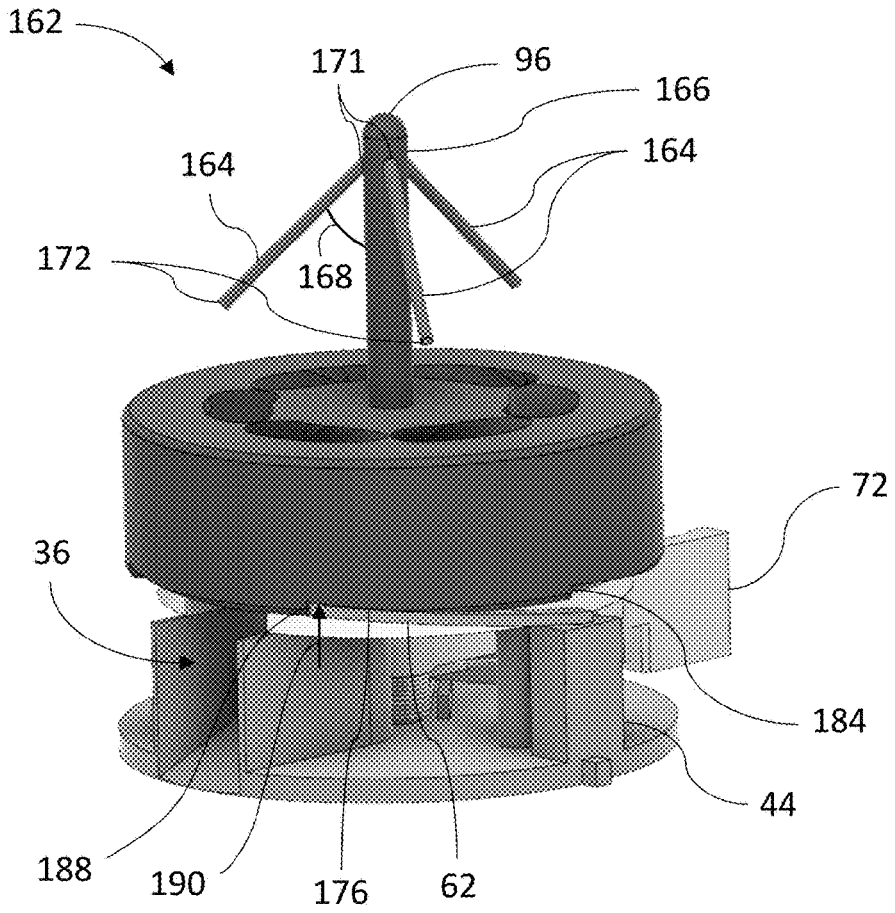
Figure 9:
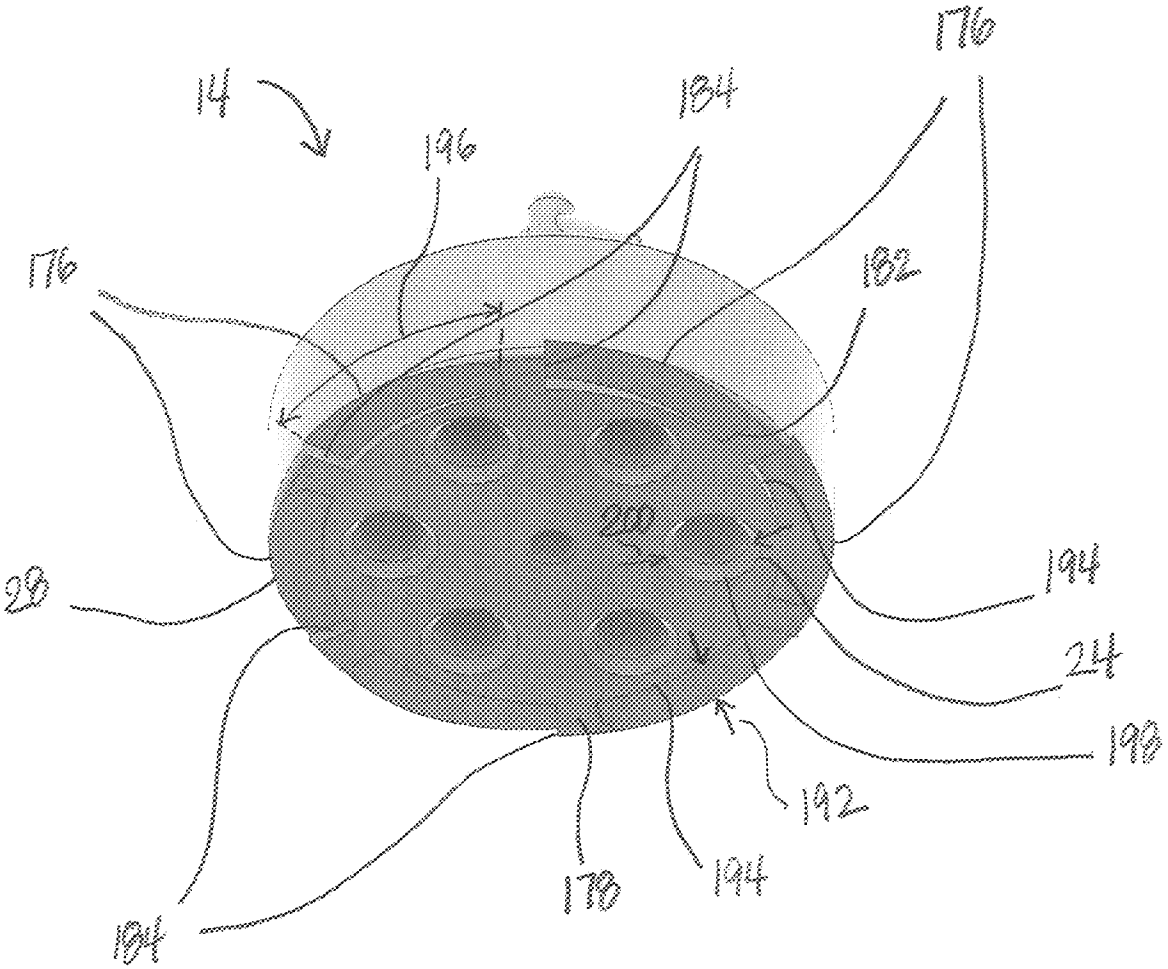

FIGS. 8A-8B are partial perspective views of the dispenser 10 of FIG. 1 (with the shell 12 removed for clarity). FIG. 9 is a bottom perspective view of the rotor 14 of FIG. 3. In the illustrated embodiment, the dispenser 10 further includes an agitator 162 coupled to the rotor shaft 96. The agitator 162 agitates pills 130 residing in the inner cavity 22 to assist gravity in directing the pills 130 into the funneled openings 88 of the shell 12. The agitator 162 is disposed within the inner cavity 22 of the shell 12 (FIG. 2). As the lever 72 effects rotation of the rotor 14, the agitator 162 also rotates with the rotor shaft 96 to agitate the pills 130. As such, with one movement (i.e., of the lever 72) one pill 130 is dispensed from the dispenser 10, and the pills 130 residing in the inner cavity 22 are directed to the funneled openings 88 to be dispensed thereafter.

In the illustrated embodiment, the agitator 162 include agitator fingers 164 extending downward from a top portion 166 of the rotor shaft 96 at an angle 168 (FIG. 8A) relative to the rotor shaft 96. In one embodiment, the angle 168 may be in the range of thirty to sixty degrees. The fingers 164 are uniformly circumferentially spaced relative to the rotor shaft 96. The fingers 164 are uniform in size and shape and have a length 170 (FIG. 8B) sufficient to agitate the pills 130 adjacent to the entrances 104 of the funneled openings 88. Disposing the fingers 164 at the angle 168 allows the fingers 164 to agitate the pills 130 at various heights within the inner cavity 22. The ends 171 of the fingers 164 adjacent to the rotor shaft 96 agitate pills 130 disposed at the top of the inner cavity 22, and ends 172 of the fingers 164 adjacent the rotor 14 agitate pills 130 disposed proximate the funneled openings 88. The fingers may comprise a flexible plastic, such as the plastic used in plastic straws. In the illustrated embodiment, the agitator 162 has three fingers 164; however, more or less may be utilized.

In the illustrated embodiment, the indexing mechanism 18 is configured to index the rotor 14 to the index positions such that in each index position, one of the pill receptacles 24 is aligned with the pill-dispense opening 36. Movement of the lever 72 from the home position to the dispense position correspondingly effects movement of an end 174 of the indexing leaf spring 76.

In the illustrated embodiment, the rotor 14 includes a plurality of indexing ramps 176 (also shown in FIG. 9) configured to engage with the indexing leaf spring 76 and the stopping leaf spring 62 of the indexing mechanism 18. In one embodiment, a number of indexing ramps 176 of the rotor 14 equals a number of index positions of the rotor 14. Indexing ramps 176 may be formed in the bottom surface 28 of the rotor 14 along an outer circumferential area 178 (FIG. 9) thereof. Each indexing ramp 176 has a starting depth 180 measured from the bottom surface 28 that gradually reduces to the bottom surface 28. In the home position, the end 174 of the indexing leaf spring 76 abuts a vertical wall 184 disposed adjacent to the indexing ramp 176 such that the indexing leaf spring 76 pulls the rotor 14 in the rotational direction 70 as the lever 72 is moved to the dispense position. As the lever 72 returns to the home position (after reaching the dispense position), the end 174 of the indexing leaf spring 76 travels along the indexing ramp 176 due to biasing of the indexing leaf spring 76 in the vertical direction 134 and, once in the home position, engages with the adjacent indexing ramp 176 associated with the next index position.

In one embodiment, the indexing leaf spring 76 is preformed such that the end 174 of the indexing leaf spring 76 applies a biasing force 186 onto the rotor 14 that is sufficiently large to ensure the end 174 of the indexing leaf spring 76 projects upwards for engaging with the vertical walls 184. The biasing force 186 may be sufficiently small such that the end 174 of the indexing leaf spring 76 does not cause movement of the rotor 14 opposite the rotational direction 70 when the lever 72 returns to the home position (from the dispense position).

In the illustrated embodiment, to ensure no movement of the rotor 14 opposite rotational direction 70, the stopping leaf spring 62 also engages with vertical walls 184 formed in bottom surface 28 of the rotor 14. The stopping leaf spring 62 extends from the stopping leaf spring post 44 in the rotational direction 70, while the indexing leaf spring 76 extends from a middle of the lever 72 opposite the rotational direction 70. One of ordinary skill in the art will understand that the leaf springs 62, 76 can extend in the rotational direction 70 or opposite the rotational direction 70 in other embodiments. The leaf springs 62, 76 curve radially inwardly (from the post 44 or lever 72) to correspond with the curvature of the rotor 14 and of the indexing ramps 176 (as best shown in FIG. 1).

In one embodiment, the stopping leaf spring 62 is preformed such that an end 188 of the stopping leaf spring 62 applies a biasing force 190 onto the rotor 14 that is sufficiently large to ensure the end 188 of the stopping leaf spring 62 projects upwards to engage with the vertical walls 184. The biasing force 190 may be sufficiently small such that the stopping leaf spring 62 does not prevent movement of the rotor 14 in the rotational direction 70 when the lever 72 moves to the dispense position from the home position. In some embodiments, the dispenser does not include the stopping leaf spring.

Referring to FIG. 9 showing the bottom surface of the rotor 14, in the illustrated embodiment, the indexing ramps 176 may have a width 192 that accommodates a width of the ends 174, 188 of the leaf springs 76, 62 (FIGS. 8A-8B). The width 192 of the indexing ramps 176 is greater than the widths of the ends 174, 188 of the leaf springs 76, 62 to account for some movement of the ends 174, 188 in a radial direction (upon movement of the lever 72 between the home and dispense positions). The indexing ramps 176 also include inner walls 194 to prevent radially inward movement of the leaf springs 76, 62 past the walls 194. By sloping the indexing ramps 176 between adjacent vertical walls 184 (FIGS. 8A-8B), the lever 72 is able to travel to the adjacent vertical wall 184 for indexing to the next dispense position. Although the indexing ramps 176 in the illustrated embodiment cover a majority of the outer circumferential area 178 on the bottom surface 28 of the rotor 14, one of ordinary skill in the art will understand that in other embodiments, the indexing ramps may have a greater slope such that the indexing ramps have a smaller arcuate length 196. Furthermore, the number of vertical walls 184 corresponds to the number of index positions, and the distance between adjacent vertical walls 184 corresponds to the number of receptacles 24 in the rotor 14.

Still referring to FIG. 9, bottom portions 198 of the pill receptacles 24 may be beveled and funnel radially outwardly to a greater width 200 (relative to the main width 144 of the pill receptacles 24 shown in FIG. 5).

Pill, as used herein, may be any size or shape and may be medication, candy, food, or the like that a user(s) may desire to receive one at a time or one dose at a time. Furthermore, "rotatably coupled" as used herein means that either or both of the two elements (rotatably coupled together) may rotate relative to the other.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A pill dispenser comprising:

a floor adapted to be coupled to a shell to define an inner cavity disposed above the floor for receiving a plurality of pills, the floor having a funneled opening extending therethrough, wherein the funneled opening has an entrance at a top of the floor and a smaller exit below the entrance at a bottom of the floor;

a rotor rotatably coupled adjacent the bottom of the floor and having a plurality of pill receptacles extending from a top surface to a bottom surface of the rotor and a plurality of corresponding separation ramps, wherein each separation ramp extends from the top surface downward to connect with one side of the corresponding pill receptacle; and a base coupled to the rotor opposite the floor and having a pill-dispense opening; and an indexing mechanism coupled to the rotor to index the rotor in a rotational direction relative to the base to a plurality of index positions, wherein in each of the index positions one of the pill receptacles aligns with the exit of the funneled opening and another of the pill receptacles aligns with the pill-dispense opening, wherein the floor has a plurality of funneled openings extending therethrough that are circumferentially spaced, wherein the top of the floor has a raised center section that extends radially outwardly from a rotor shaft disposed along a central longitudinal axis that extends through a center of the rotor, and wherein the top of the floor has a raised outer section that extends radially inwardly from an outer perimeter of the floor, the raised center and outer sections extending downward to connect with entrances of the funneled openings.

2. The pill dispenser of claim 1, wherein the funneled opening defines a longitudinal axis, and wherein the entrance and exit of the funneled opening is centered around the longitudinal axis.

3. The pill dispenser of claim 1, wherein the funneled opening gradually reduces in size between the entrance and exit.

4. The pill dispenser of claim 1, wherein the funneled opening includes a rounded region between the entrance and exit.

5. The pill dispenser of claim 1, wherein the indexing mechanism comprises:

an actuation lever rotatably coupled to a support shaft of the base;

a biasing member coupled to the actuation lever for biasing the actuation lever opposite a rotational direction of the rotor; and an indexing leaf spring coupled to the actuation lever and biased upwards to engage with a plurality of indexing ramps disposed on a bottom of the rotor.

6. The pill dispenser of claim 1, further comprising an agitator coupled to a rotor shaft of the rotor and disposed within the inner cavity, wherein the agitator agitates the pills residing in the inner cavity.

7. The pill dispenser of claim 1, wherein each separation ramp extends from the top surface of the rotor downwards to an intermediate height of the corresponding pill receptacle, the intermediate height being measured from the bottom surface of the rotor and being less than a large dimension of the pills.

8. The pill dispenser of claim 1, further comprising an indicator window over an outer wall of the rotor such that in each of the index positions, dosage indicia included on the outer wall of the rotor is viewable through the indicator window.

9. A pill dispenser comprising:

a floor adapted to be coupled to a shell to define an inner cavity for storing a plurality of pills, the floor having a funneled opening extending therethrough;

a rotor rotatably coupled to the floor and having a plurality of pill receptacles extending from a top surface to a bottom surface of the rotor and a plurality of corresponding separation ramps, wherein each separation ramp extends from the top surface downward to an intermediate height of the corresponding pill receptacle, wherein each pill receptacle has a width for containing a small dimension of the pills and a total height greater than the intermediate height, the intermediate height being less than a large dimension of the pills;

a base coupled to the rotor opposite the floor and having a pill-dispense opening; and an indexing mechanism coupled to the rotor to index the rotor in a rotational direction relative to the base to a plurality of index positions, wherein in each of the index positions one of the receptacles of the plurality aligns with the pill-dispense opening, the indexing mechanism comprising:

an actuation lever rotatably coupled to a support shaft of the base;

a biasing member coupled to the actuation lever for biasing the actuation lever opposite a rotational direction of the rotor; and an indexing leaf spring coupled to the actuation lever and biased upwards to engage with a plurality of indexing ramps disposed on a bottom of the rotor.

10. The pill dispenser of claim 9, wherein the top of the floor has a raised center section along a central longitudinal axis that extends through a center of the rotor, and wherein the top of the floor has a raised outer section that extends radially inwardly from an outer perimeter of the floor, the raised center and outer sections extending downward to align with the funneled opening.

11. The pill dispenser of claim 9, wherein the funneled opening has an entrance at a top of the floor and a smaller exit below the entrance at a bottom of the floor.

12. The pill dispenser of claim 11, wherein the funneled opening defines a longitudinal axis, and wherein the entrance and exit of the funneled opening is centered around the longitudinal axis.

13. The pill dispenser of claim 9, wherein the intermediate height is in the range of 65% to 85% of the total height.

14. The pill dispenser of claim 9, wherein the intermediate height is 75% of the total height.

15. A pill dispenser comprising:

a shell having an inner cavity to receive a plurality of pills, the shell having a plurality of funneled openings defined along a floor of the shell, each funneled opening sized to receive at least one of the plurality of pills;

a rotor coupled to the shell adjacent the floor and having a plurality of pill receptacles extending through the rotor;

a base coupled to the rotor opposite the shell and having a pill-dispense opening; and an indexing mechanism coupled to the rotor to index the rotor relative to the base to a plurality of index positions, wherein in each index position one of the funneled openings aligns with one of the pill receptacles and one of the pill receptacles aligns with the pill-dispense opening, wherein the indexing mechanism comprises:

an actuation lever rotatably coupled to a support shaft of the base;

a biasing member coupled to the actuation lever for biasing the actuation lever opposite a rotational direction of the rotor; and an indexing leaf spring coupled to the actuation lever and biased upwards to engage with a plurality of indexing ramps disposed on a bottom of the rotor.

16. The pill dispenser of claim 15, further comprising an agitator coupled to a rotor shaft of the rotor and disposed within the inner cavity, wherein the agitator agitates the pills residing in the inner cavity.

17. The pill dispenser of claim 16, wherein the agitator includes at least one agitator finger extending downward from the rotor shaft at an angle relative to the rotor shaft, the at least one agitator finger having a length to agitate pills adjacent entrances of the funneled openings.

18. The pill dispenser of claim 15, wherein the base has a plate abutting a bottom of the rotor, the plate having a slot aligned with the pill-dispense opening.

19. The pill dispenser of claim 15, wherein a top surface of the floor has a raised center section that extends radially outwardly from a rotor shaft disposed along a central longitudinal axis that extends through a center of the rotor, and wherein the top of the floor has a raised outer section that extends radially inwardly from an outer perimeter of the floor, the raised center and outer sections extending downward to connect with entrances of the funneled openings.

20. The pill dispenser of claim 15, wherein each of the funneled openings extends through the floor and includes an entrance at a top of the floor, an exit below the entrance at a bottom of the floor, and a rounded region between the entrance and exit.

* * * * *